US008020218B2

(12) United States Patent
Stingone

(10) Patent No.: US 8,020,218 B2
(45) Date of Patent: Sep. 20, 2011

(54) BASEBALL CAP WITH NECK PROTECTION VISOR

(76) Inventor: Richard Stingone, Rye Brook, NY (US)

( * ) Notice: Subject to any disclaimer, the term of this patent is extended or adjusted under 35 U.S.C. 154(b) by 42 days.

(21) Appl. No.: 12/322,950

(22) Filed: Feb. 9, 2009

(65) Prior Publication Data

US 2009/0199321 A1 Aug. 13, 2009

Related U.S. Application Data

(60) Provisional application No. 61/065,421, filed on Feb. 12, 2008.

(51) Int. Cl.
*A42B 1/00* (2006.01)

(52) U.S. Cl. ..... 2/209.12; 2/209.13; 2/175.1; 2/175.7

(58) Field of Classification Search ..... 2/209.12, 2/209.13, 175.1, 175.7
See application file for complete search history.

(56) References Cited

U.S. PATENT DOCUMENTS

| | | | | |
|---|---|---|---|---|
| 4,556,993 | A | 12/1985 | Okamura, Sr. | |
| 4,741,053 | A * | 5/1988 | Okamura, Sr. | 2/209.12 |
| 4,864,662 | A * | 9/1989 | Frank | 2/183 |
| 5,161,259 | A | 11/1992 | Shorts | |
| 5,197,150 | A | 3/1993 | Bedient | |
| 5,253,364 | A * | 10/1993 | Robinson | 2/10 |
| 5,553,325 | A * | 9/1996 | Gutierrez | 2/171 |
| 5,666,668 | A | 9/1997 | Ronquillo | |
| 5,669,071 | A | 9/1997 | Vu | |
| 5,689,830 | A | 11/1997 | Pflum | |
| 6,128,786 | A * | 10/2000 | Maddux et al. | 2/418 |
| 6,453,475 | B1 | 9/2002 | Johnson | |
| 6,910,226 | B2 | 6/2005 | Hoyez | |
| D510,178 | S | 10/2005 | Kobayashi et al. | |
| 7,185,371 | B2 * | 3/2007 | Koo | 2/209.13 |
| 2002/0066134 | A1 | 6/2002 | Seo | |
| 2005/0132461 | A1 * | 6/2005 | Koo | 2/12 |
| 2005/0257310 | A1 * | 11/2005 | Jang | 2/209.13 |
| 2006/0162037 | A1 * | 7/2006 | Yan | 2/12 |
| 2006/0242751 | A1 * | 11/2006 | Koo | 2/171 |

FOREIGN PATENT DOCUMENTS

WO WO 2007/128042 11/2007

* cited by examiner

*Primary Examiner* — Khoa Huynh
*Assistant Examiner* — Alissa J Tompkins
(74) *Attorney, Agent, or Firm* — Robert L. Epstein; Epstein Drangel LLP

(57) ABSTRACT

The head covering includes a skull portion, a visor and an expandable section for connecting the visor and the skull portion. The expandable section is moveable between an expanded position and a retracted position to move the visor between a generally horizontal position to shade the eyes and a generally vertical position to protect the back of the neck. The expandable section is interposed between and connects the skull portion and the visor. The expandable section is formed of flexible material that is easily folded.

7 Claims, 6 Drawing Sheets

BASEBALL CAP WITH NECK PROTECTION VISOR

CROSS-REFERENCE TO RELATED APPLICATIONS

Priority is claimed on Provisional Patent Application Ser. No. 61/065,421 filed Feb. 12, 2008.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to head coverings in the form of caps, and more particularly to a baseball cap with a visor capable of protecting the back of the neck of the wearer.

2. Description of Prior Art Including Information Disclosed Under 37 CFR 1.97 and 1.98

Head coverings of various types and styles are well known, particularly hats with visors commonly used to protect the eyes of the wearer from the elements. Such hats are widely used in sports, especially baseball, in the form of a baseball cap and are often provided with a team logo or other insignia on the front of the skull portion that covers the head. The visor extends outwardly from the rim of the skull portion along the front thereof. In that position, the visor functions to shade the eyes of the wearer from the elements, such as the sun and rain.

However, the visor is of little use in shielding the back of the wearer's neck from the sun. As a consequence, the back of the neck of a wearer of a baseball cap is exposed and vulnerable to sunburn.

Further, the rules for organized baseball leagues require batters to wear a protective batting helmet which is a hard plastic shell that covers the skull and usually at least one ear of the batter. However, the helmet provides no protection whatsoever for the back of the neck of the wearer. As a result, the back of the batter's neck may take a direct hit from a wild pitch which can be painful and cause serious injury.

It is, therefore, a prime object of the present invention to provide a head covering in the form of a baseball cap with a visor that is capable of protecting the back of the neck of the wearer.

It is another object of the present invention to provide a head covering in the form of a baseball cap with a visor that is mounted to the rim of the skull portion by expandable means.

It is another object of the present invention to provide a head covering in the form of a baseball cap with a visor wherein the expandable means includes a flexible material section that can be easily folded.

It is another object of the present invention to provide a head covering in the form of a baseball cap with a visor with a section that expands to a position in alignment with the back of the wearer's neck when the cap is rotated to face backward.

It is another object of the present invention to provide a head covering in the form of a baseball cap with a visor with a section that retracts to the normal visor position.

It is another object of the present invention to provide a head covering in the form of a baseball cap with a visor having an expandable section and means for retaining the visor in the normal visor position when the expandable section is retracted.

It is another object of the present invention to provide a head covering for use under a protective batting helmet to protect the back of the neck of the wearer from injury from a wild pitch.

BRIEF SUMMARY OF THE INVENTION

The above mentioned objectives are achieved by the present invention which relates to a head covering that includes a skull portion, a visor and expandable means for connecting the visor and the skull portion.

The expandable means is moveable between an expanded position and a retracted position to move the visor between a generally horizontal position and a generally vertical position.

The expandable means includes a collapsible section interposed between the skull portion and the visor. The expandable means interposed between and connects the rim of the skull portion and the edge of the visor.

The expandable means includes a flexible material that is foldable.

The material of the expanded means may have printed matter on a surface thereof which is exposed when the expandable section is in the expanded position.

The head covering also has means for securing the expandable means in the retracted position. The securing means may take the form of inter-engaging hook and loop ribbon segments.

Preferably, the head covering takes the form of a baseball cap.

In accordance with another aspect of the present invention, a head covering is provided including a skull portion, a visor, expandable means connecting the skull portion and the visor, and a protective helmet.

In use, the head covering is placed on the head with the visor facing backward. The expandable means is expanded such that the visor aligns with at least a portion of the neck of the wearer. The helmet is situated over the head covering.

BRIEF DESCRIPTION OF THE SEVERAL VIEWS OF DRAWINGS

To these and to such other objects that may hereinafter appears, the present invention relates to a base ball cap with neck protection visor as described in detail in the following specification and recited in the annexed claims, taken together with the accompanying drawings, in which like numerals refer to like parts and in which:

DETAILED DESCRIPTION OF THE INVENTION

Figure 1:
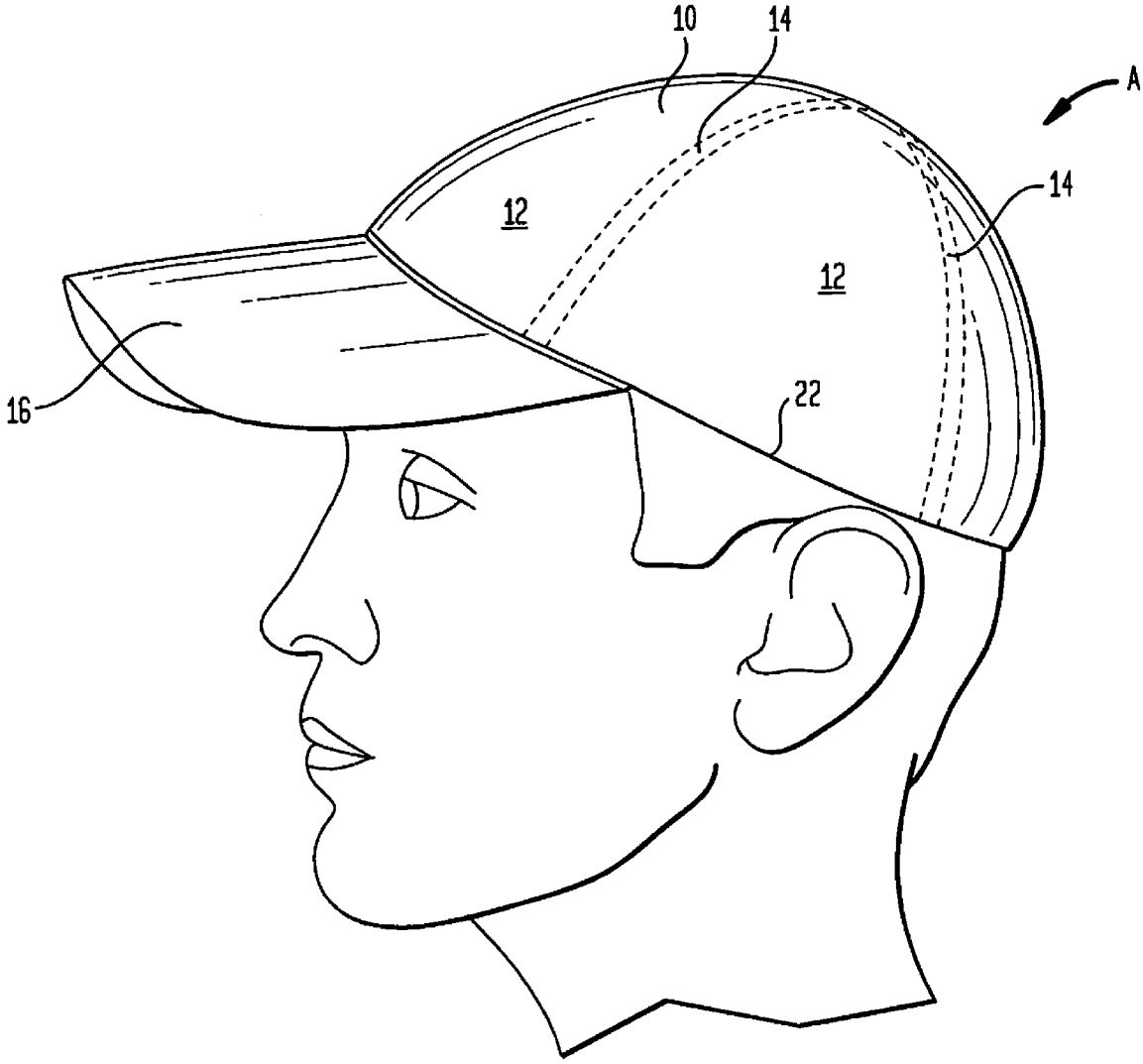
FIG. 1 is a side view of an individual wearing the cap of the present invention with the expandable section in the retracted position.

FIG. 1 illustrates the head covering of the present invention, which preferably takes the form of a baseball cap, generally designated A, as it would appear on the head of an individual when the expandable section is in the retracted position. Cap A includes a skull portion 10 formed of strips 12 of soft flexible cloth or fabric material sewn together along stitch lines to form a substantially hemispherical member. The stitch lines (not shown) are preferably covered on the interior surface of the skull portion by strips 14 of similar material.

Visor 16 extends outwardly from skull portion 10. Visor 16 is preferably made of the same material as skull portion 10 but the material is mounted on a base material such as cardboard or plastic to give it sufficient body to retain its shape.

In this figure, the expandable section 18 is hidden, the expandable means being situated entirely within the skull portion in its retracted position. Consequently, cap A appears to be a conventional baseball cap.

Figure 3:
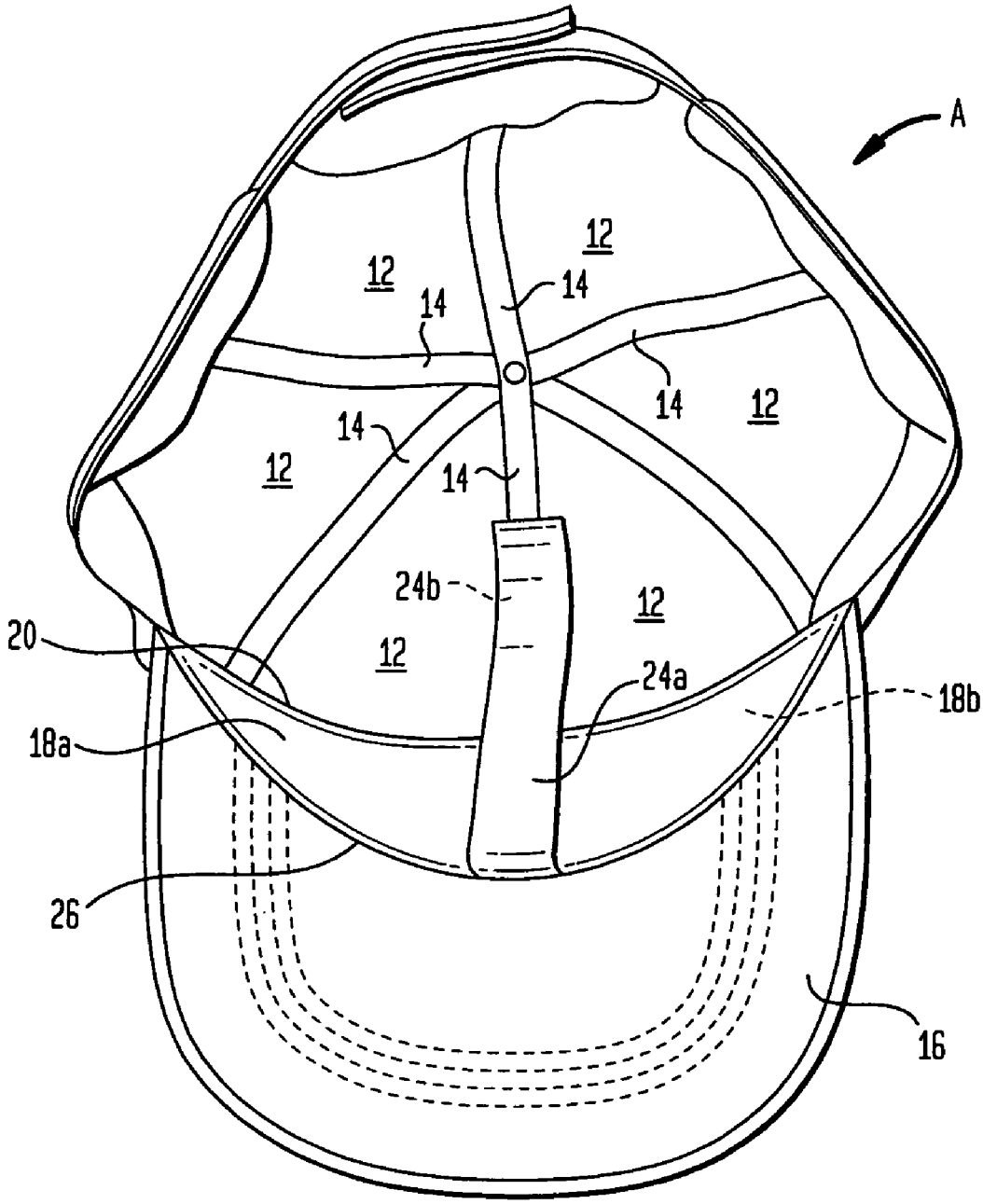
FIG. 3 is a bottom view of the cap of the present invention showing the expanded section in the retracted position.
Figure 4:
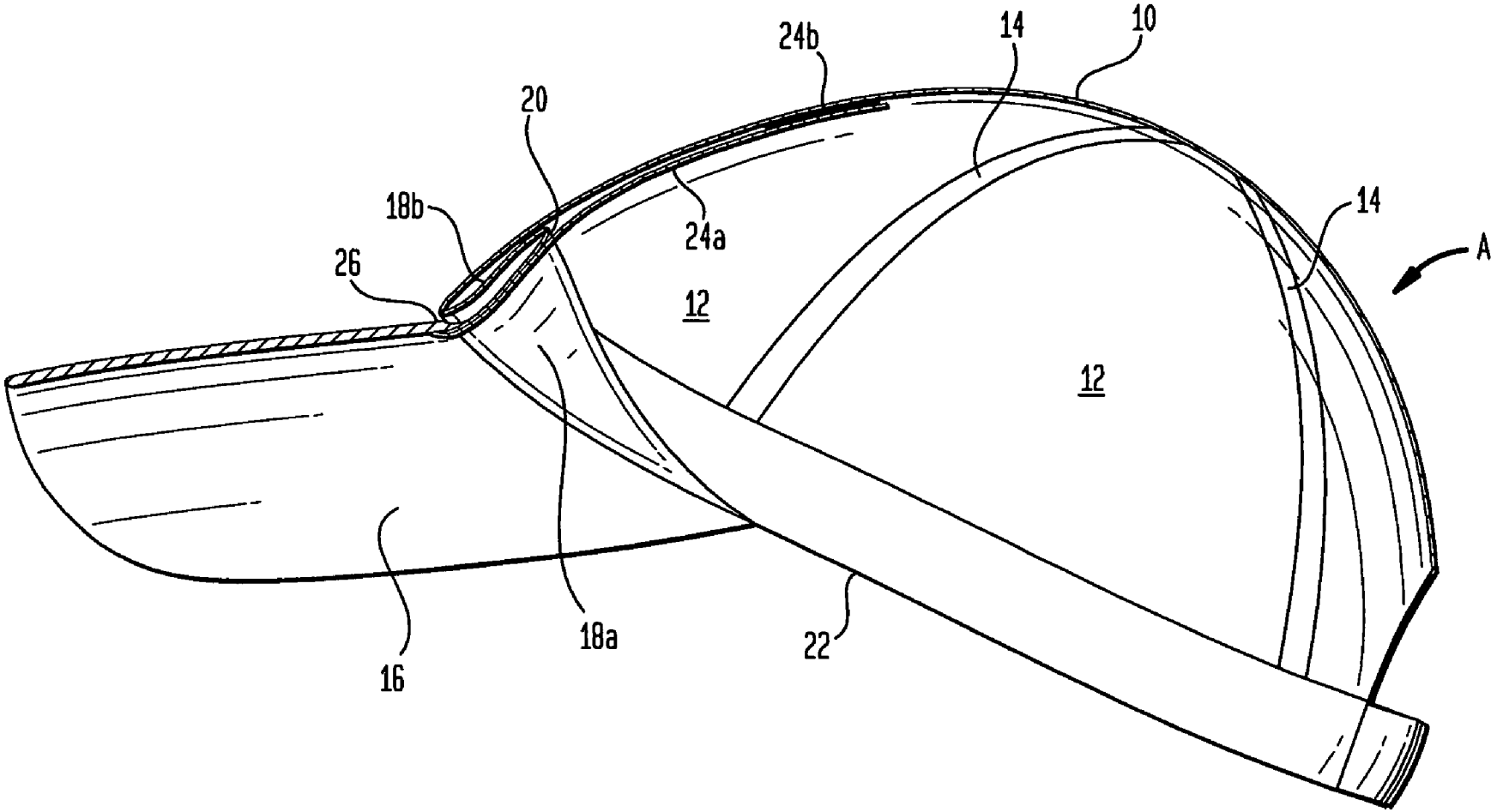
FIG. 4 is a side cross-sectional view of the cap of the present invention with the expandable section in the retracted position.
Figure 5:
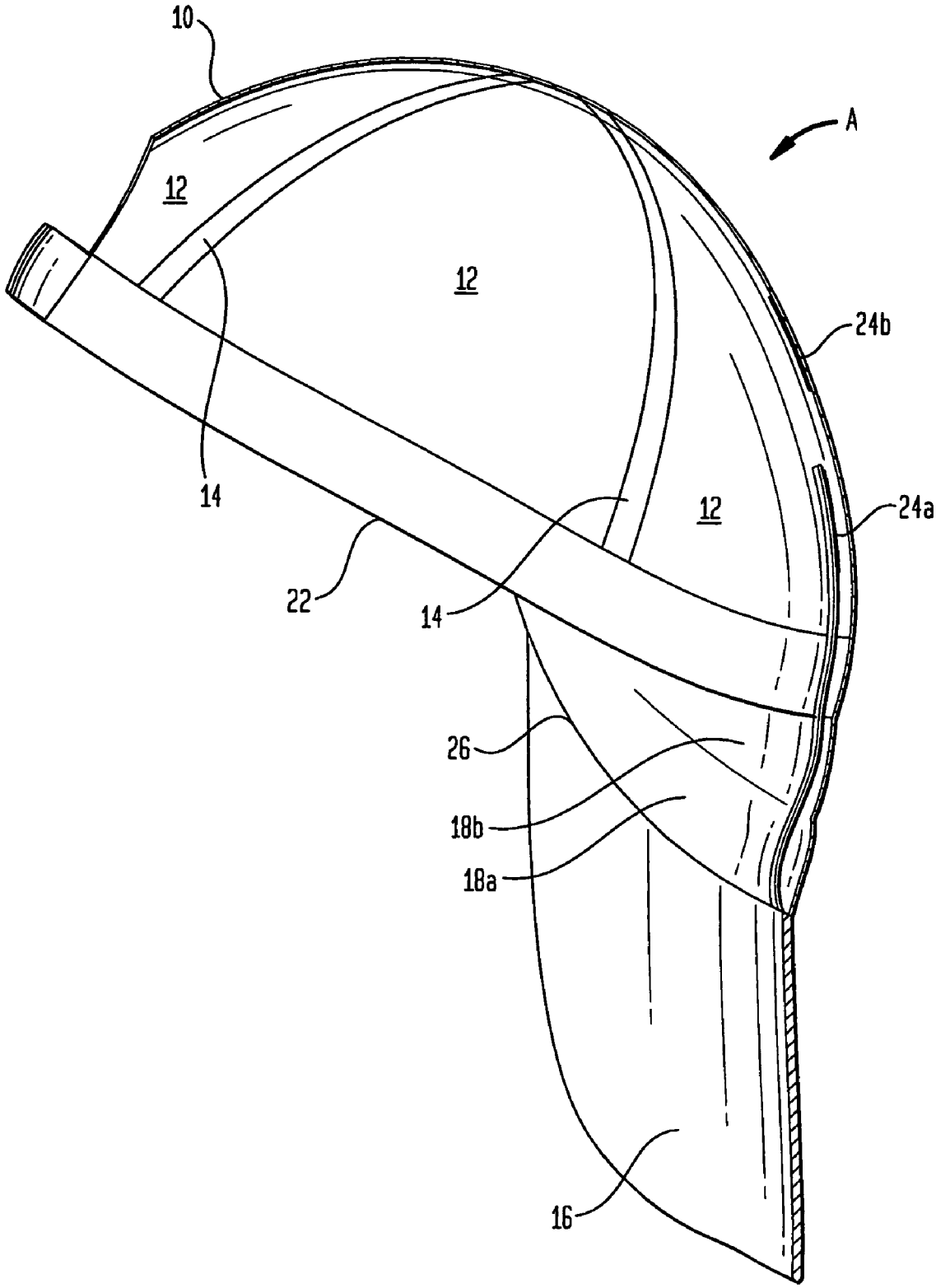
FIG. 5 is a side cross-sectional view of the cap of the present invention with the expandable section in the expanded position as it would be worn under a batting helmet.

FIGS. 3 and 4 are respectively bottom and side cross-section views of cap A with the expanded section 18 in the retracted position. Section 18 includes two portions, 18*a* and 18*b* separated by a fold 20. In FIG. 3, portion 18*a*, which extends from edge 26 of visor 16 to fold 20, is visible. In FIG. 4, portion 18*a* is visible as well as portion 18*b*, the latter of which extends between fold 20 and the rim 22 of skull portion 10.

Accordingly, the expandable section 18 extends between the rim 22 of skull portion 12 and edge 26 of visor 16 which faces rim 22. The expandable section 18 is fabricated of flexible material that is foldable along fold line 20 to define first and second portions 18*a* and 18*b*. Portion 18*a* extends from edge 26 of visor 16 to fold 20. Portion 18*b* extends from fold 20 to rim 22 of skull portion 12. When the expandable section material is folded, sections 18*a* and 18*b* are in substantially face-to-face relation as seen in FIG. 4 and edge 26 of visor 16 is adjacent to rim 22 of skull portion 12, as seen in FIG. 1.

Section 18 is preferably formed of the same flexible material as skull portion 10 such that it can be easily folded along fold 20, as seen in FIG. 4, to retract the visor. Means, in the form of sections 24*a* and 24*b* of hook and loop ribbon, are provided for securing section 18 in the retracted position.

Hook and loop ribbon section 24*a* extends from edge 26 of visor 16. Hook and loop section 24*b* is fixed to the interior surface of skull portion 10. When engaged with section 24*b*, section 24*a* maintains expandable section 18 in the retracted position.

Figure 2:
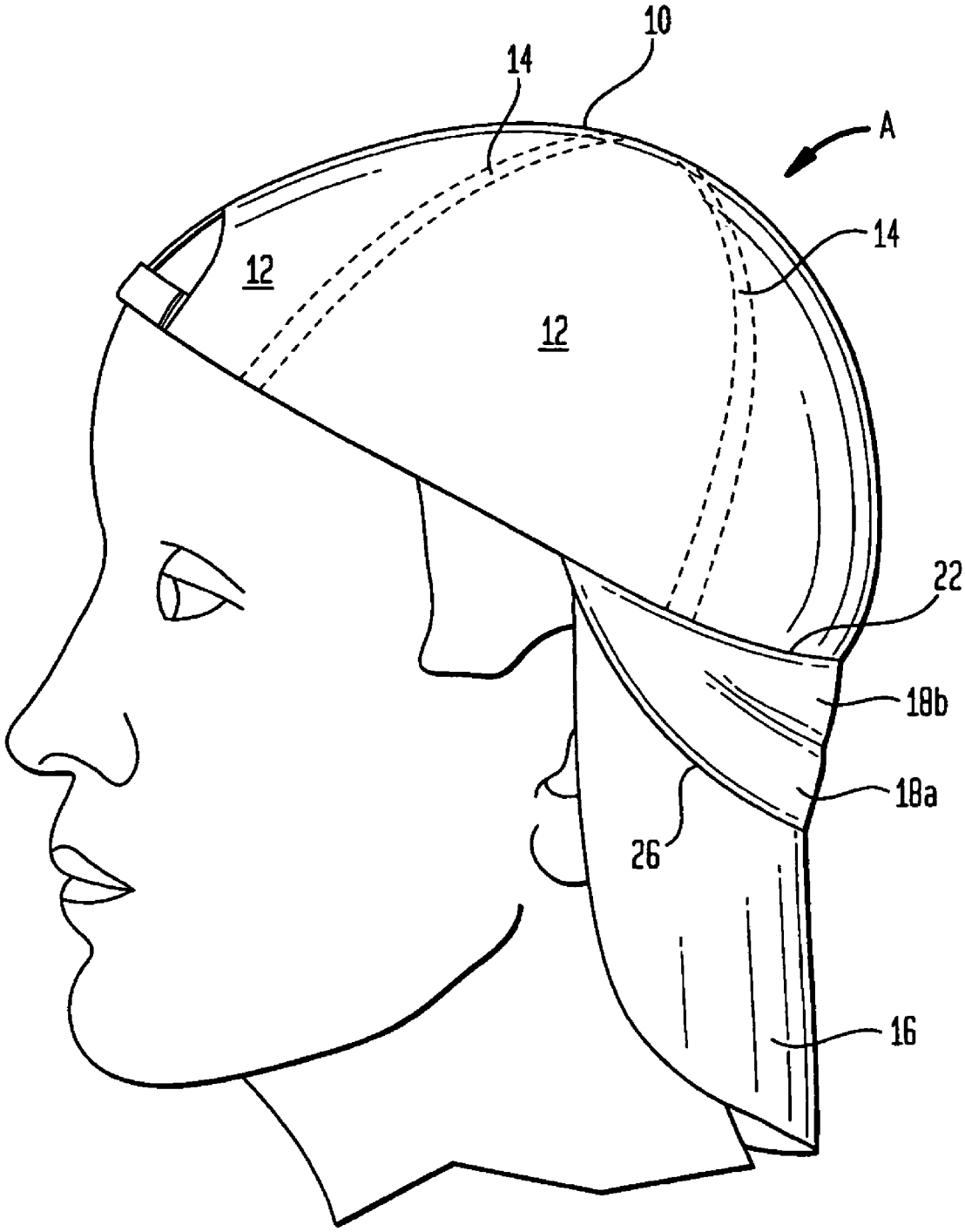
FIG. 2 is a side view of an individual wearing the cap of the present invention with the cap turned so that the visor is in the rear and the expandable section expanded such that the visor aligns with the back of the neck of the wearer.

Releasing section 24*a* from section 24*b* permits section 18 to expand such that visor 16 moves away from skull portion 10. FIG. 2 shows cap A turned around on the head of the wearer with section 18 in the expanded position. In that position, expandable section is visible and visor 16 is aligned with the back of the neck of the wearer. Printed matter, in the form of advertising or the like, may be present on the exterior surface of section 18 such that it is visible when section 18 is expanded.

Figure 6:
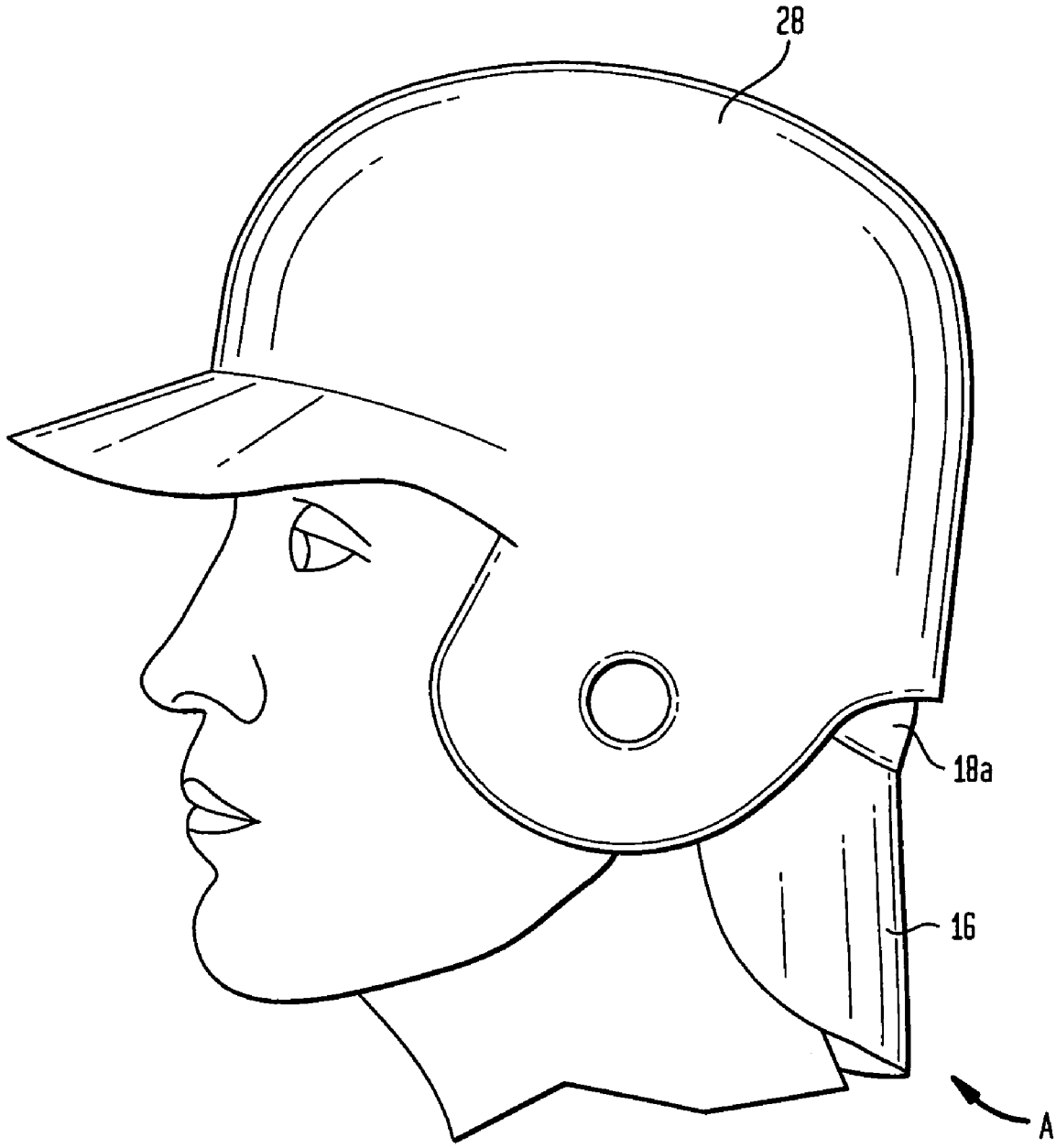
FIG. 6 is a side view of an individual wearing the cap of the present invention under a batting helmet.

FIG. 6 illustrates the use of cap A, as it appears in FIG. 2, in conjunction with a conventional batting helmet 28. With helmet 28 situated over cap A, visor 16 is aligned with and protects the back of the neck of the wearer.

It will now be appreciated that the head covering of the present invention takes the form of a baseball cap which includes a skull portion, a visor and an expandable section for connecting the visor and the skull portion. The expandable section is moveable between an expanded position and a retracted position to move the visor between a generally horizontal position, where the eyes of the wearer are protected from sun or rain, and a generally vertical position aligned with the back of the neck of the wearer. In the latter position, the cap may be used with a batting helmet to protect the back of the neck of the wearer.

The expandable section is interposed between and connects the skull portion and the visor. The expandable section is formed of flexible material which can be folded to move the visor between its horizontal and vertical positions.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

I claim:

1. A head covering comprising a skull portion having a dome shape, a rim, and a visor having an edge facing said rim and expandable means interposed between said rim of said skull portion and said edge of said visor, said expandable means comprising material foldable along a fold line to define first and second portions, the first portion being attached to and extending from said edge of said visor and the second portion extending from said rim of said skull portion, such that said first and second portions are in substantially face-to-face relation and said edge of said visor is substantially adjacent said rim of said skull portion when said material is folded, wherein said expandable means is moveable between an expanded position and a retracted position to move said visor between a position proximate said skull portion and a position remote from said skull portion, and means for securing said expandable means in said retracted position, wherein said expandable means is situated entirely within said skull portion in said retracted position.

2. The covering of claim 1 wherein said securing means comprises inter-engaging hook and loop ribbon segments.

3. The covering of claim 1 in the form of a baseball cap.

4. A head covering comprising a skull portion having a dome shape, a rim, and a visor having an edge facing said rim, expandable means interposed between said rim of said skull portion and said edge of said visor, said expandable means comprising material foldable along a fold line to form first and second portions, the first portion being attached to and extending from said edge of said visor and the second portion extending from said rim of said skull portion, such that said first and second portions are in substantially face-to-face relation and said edge of said visor is substantially adjacent said rim of said skull portion when said material is folded, wherein said expandable means is moveable between an expanded position and a retracted position to move said visor between a position proximate to said skull portion and a position remote from said skull portion, means for securing said expandable means in said retracted position and a protective helmet, wherein said expandable means is situated entirely within said skull portion in said retracted position.

5. The covering of claim 4 wherein said skull portion is placed on the head with the visor facing backward, the expandable means is expanded such that the visor is aligned with at least a portion of the neck of the wearer and the helmet is situated over the skull portion.

6. The covering of claim 4 in the form of a baseball cap.

7. The covering of claim 4 wherein said securing means comprises inter-engaging hook and loop ribbon segments.

* * * * *